United States Patent [19]

Naturel et al.

[11] 4,372,494

[45] Feb. 8, 1983

[54] SPRAY NOZZLE

[75] Inventors: Christian Naturel, Pacy; Etienne Minot, Saint Andre, both of France

[73] Assignee: Carbonisation Entreprise et Ceramique (C.E.C.), Montrouge, France

[21] Appl. No.: 235,939

[22] Filed: Feb. 19, 1981

[30] Foreign Application Priority Data

Feb. 28, 1980 [FR] France ..... 80 04438

[51] Int. Cl.[3] ..... B05B 1/14

[52] U.S. Cl. ..... 239/553.3; 239/567

[58] Field of Search ..... 239/504, 524, 533.3, 239/533.14, 542, 548, 550, 551, 553, 553.3, 562, 567, 570, 589, 590, 590.3, 590.5, 596, 601; 138/40, 44

[56] References Cited

U.S. PATENT DOCUMENTS

| | | | |
|---|---|---|---|
| 659,843 | 10/1900 | Bray | 239/590.3 |
| 2,256,729 | 9/1941 | Thompson | 239/553.3 |
| 2,650,132 | 8/1953 | Reinecke | 239/567 X |
| 2,933,259 | 4/1960 | Raskin | 239/567 X |
| 3,130,919 | 4/1964 | Baker | 239/562 X |

FOREIGN PATENT DOCUMENTS

| | | | |
|---|---|---|---|
| 1376591 | 12/1974 | United Kingdom | 239/596 |

*Primary Examiner*—Johnny D. Cherry

*Attorney, Agent, or Firm*—Kerkam, Stowell, Kondracki & Clarke

[57] ABSTRACT

Spray nozzle permitting the spraying of liquid, having a body provided with a cylindrical chamber of given diameter for the passage of a liquid into a nozzle in which the nozzle liquid outlet has a plurality of equidistantly spaced, identical holes, whose axes are inclined relative to the nozzle axis. A member positioned at the intake of the liquid into the nozzle defines a passage for the liquid outflow, and has a diameter less than the diameter of the chamber. The member has a concave face at the inlet and a constriction of the passage limits the liquid flow entering the nozzle. Fixing means permit the member to be fixed to the nozzle body.

11 Claims, 6 Drawing Figures

Figure 1A:
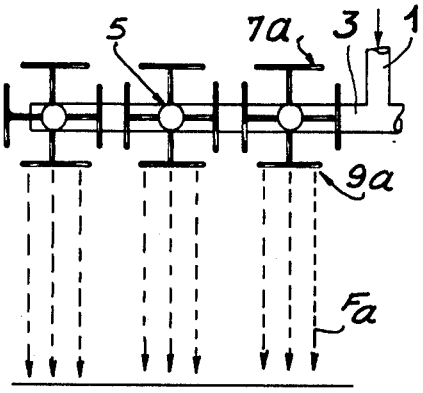

FIG.3
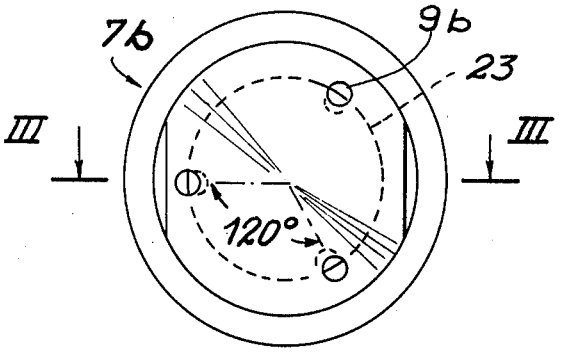
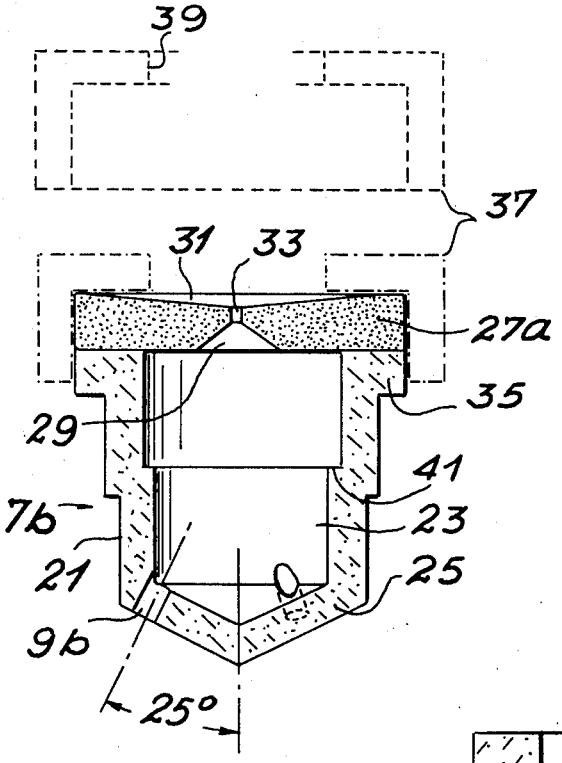
FIG.4
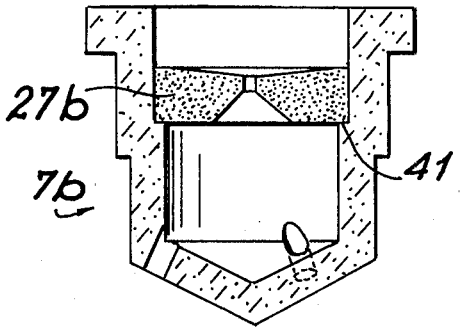
FIG.5

SPRAY NOZZLE

The present invention relates to a spray nozzle particularly for fertilisers making it possible to spray liquid fertilisers in the form of large drops. For the purpose of spreading or distributing liquid fertilisers, a spreading device is used which is fixed to a tractor and incorporates inter alia a tube of varying length into which the liquid fertiliser is introduced. This tube is equipped with a plurality of small drums, barrels or similar devices distributed in regular manner over the length of the said tube and onto which are fixed a plurality of liquid fertiliser spraying devices.

At present, these spraying devices are constituted by generally metal rods or ducts perforated by a plurality of holes and whose size varies between the individual rods. The drums or other similar devices on which said rods are mounted, e.g. four rods at an angle of 90° from one another, make it possible to select the desired rod and therefore the size of the holes. In this way, it is possible to define the liquid fertiliser spray flow rate for a given fertiliser intake pressure.

These rods have a certain number of disadvantages and in particular they are of limited strength, bulky, movable and often expensive. This is due to the fact that as these rods are made from metal, they can easily be chemically attacked or corroded by the fertilisers and therefore wear rapidly, making frequent replacement necessary.

The present invention therefore relates to a fertiliser spray nozzle which obviates the aforementioned disadvantages and which in particular has a greater resistance to chemical attacks or corrosion by the fertilisers, smaller overall dimensions and a lower cost price.

Thus, the spray nozzle according to the invention comprises:

a body provided with a cylindircal chamber of given diameter permitting the passage of the liquid into the nozzle and level with the nozzle liquid outlet has a plurality of equidistantly spaced, identical holes, whose axes are inclined relative to the nozzle axis;

a member positioned at the intake of the liquid into the nozzle defining a passage for the liquid outflow, whose diameter is less than the diameter of the chamber, said member having a concave face at the inlet and a constriction of the said passage making it possible to limit the liquid flow entering the nozzle;

fixing means permitting the said member to be fixed to the nozzle body.

According to a preferred embodiment of the invention, the nozzle body is made from a rigid plastics material and the member is made from alumina.

Moreover, according to the invention, the nozzle body has a conically shaped fluid outlet surface in such a way that the axes of the holes are perpendicular to said face.

In addition to the advantages referred to hereinbefore, the spray nozzle can easily be disassembled and cleaned which, for the farmer, is a great advantage due to the amount of material which is frequently deposited when spraying liquid fertilisers.

Figure 1B:
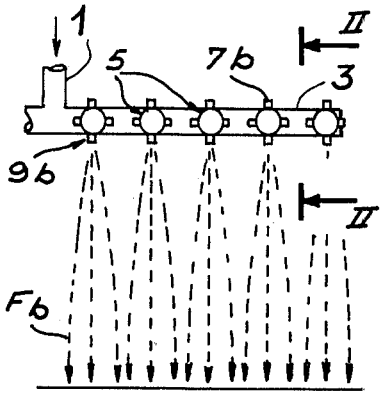

The invention is described in greater detail hereinafter relative to non-limitative embodiments and with reference to the drawings, wherein:

FIGS. 1A and 1B show diagrammatically an overall view of a liquid fertiliser distribution device; FIG. 1A a device according to the prior art and FIG. 1B a device according to the invention.

Figure 2:
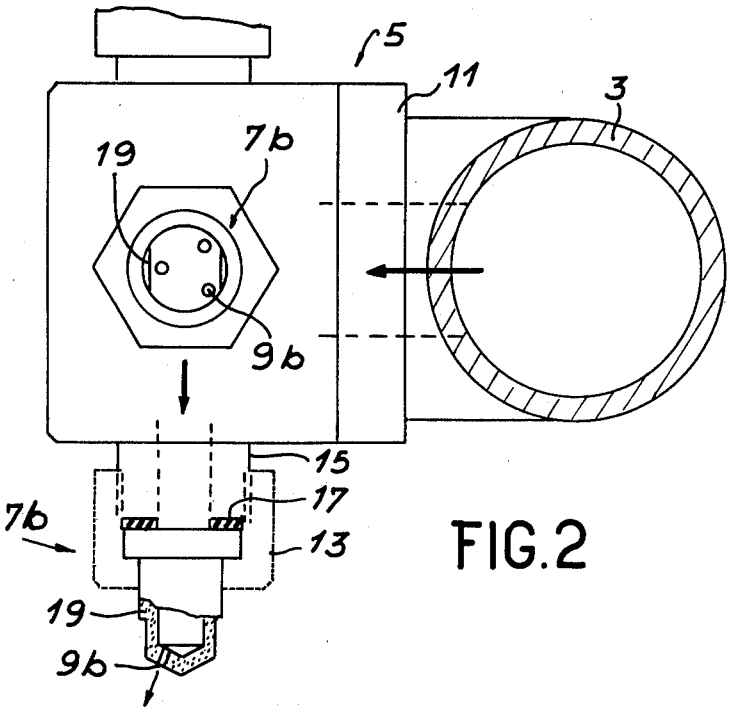

FIG. 2 a sectional view along line II—II of FIG. 1B

FIG. 3 a view from below of the spray nozzle according to the invention.

FIG. 4 a sectional view along the line III—III of FIG. 3.

FIG. 5 is a sectional view similar to FIG. 4 of another embodiment of the spray nozzle.

FIG. 1 diagrammatically shows an overall view of a liquid fertiliser distribution device. This device comprises an intake pipe 1 for liquid fertilisers, connected to a tube 3, which can be of varying length and is provided, for example, with a plurality of small drums such as 5, distributed in a regular manner along tube 3 to which are fixed a plurality of spraying devices such as *7a*.

In the prior art, shown in FIG. 1A, the spraying devices *7a* are constituted by generally metal rods preforated with a plurality of holes such as *9a*, e.g. three holes, whose size varies from one rod to the next for rods fixed to the same drum 5. For the same drum 5, the rods *7a* may, for example, be arranged at an angle of 90° from one another.

In FIG. 1B, representing the apparatus according to the invention, the spraying devices are formed by spray nozzles *7b* having a plurality of small holes *9b*.

In both cases, the drums 5 on which are placed the spraying devices *7a* or *7b* make it possible to select the desired spraying devices, i.e. the size of the holes *9a* or *9b* and as a result the desired liquid fertiliser spray flow rate can be defined. On referring to FIGS. 1A and B, it can be seen that the spraying devices according to the invention, i.e. nozzles *7b* are much less bulky than the prior art spraying devices, so that more spraying devices can be fixed to the small length tube 3. These reduced overall dimensions, associated with the lighter weight of nozzles *7b* as compared with the metal rods *7a*, makes it possible to considerably reduce the swing due to the rods *7a*, which contributes to the stability and strength of the distribution device according to the invention.

Moreover, due to the very shape of the spray nozzles *7b*, which will be described in greater detail hereinafter and the position of the holes *9b*, the liquid jets Fb pass out with a certain inclination axis with respect to the axis of nozzles *7b*. This makes it possible to spread the liquid fertilisers over a larger surface area and in a uniform manner, whereas in the prior art the liquid jets Fa strike the ground perpendicularly.

FIG. 2 is a sectional view along the line II—II of FIG. 1B. This diagram better shows the arrangements of nozzles *7b* on drum 5 connected to the tube 3 by means of a support 11. Nozzle *7b* is fixed to drum 5, for example, by means of a nut such as 13 screwed onto a threaded outlet such as 15 integral with drum 5. A gasket such as 17 can be positioned between the threaded outlet 15 and spray nozzle *7b*. On either side, the nozzle *7b* has a flat 19 for the purpose of orienting the liquid fertiliser jets.

This nozzle, shown in more detailed manner in FIGS. 3 and 4, has equidistantly spaced, identical holes *9b* for discharging the liquid. When there are three such holes, the angle between two adjacent holes *9b* is 120°. Obviously, this is only given as an example, because the spray nozzles can have 2, 3, 4 or 5 discharge holes *9b* distributed around a ring, thereby ensuring an identical outflow for each of the holes *9b*, no matter what the liquid fertiliser intake pressure. Moreover, the axes of these holes 9b are inclined relative to the axis of nozzle 7b by an angle which is preferably 25°.

Nozzle 7b comprises a body 21 having a cylindrical chamber 23 of given diameter permitting the passage of liquid fertilisers into the nozzle. Body 21, which is preferably made from a rigid plastics material, has on the fluid outlet face 25 a conical shape in such a way that the axes of holes 9b are perpendicular to said face 25.

Nozzle 7b also comprises a calibrated member 27a, preferably made from alumina with a purity of 99.5%, located at the liquid intake into nozzle 7b and defining a passage 29 to permit the outflow of the liquid and whose diameter is smaller than that of chamber 23. Member 27a has a concave face 31 making it possible to limit the liquid flow entering nozzle 7b, whilst piping the same. Thus, when the liquid meets concave face 31, it encounters a constriction 33 at right angles with respect to passage 29, so that there is a significant pressure drop. This, together with the existence of a passage 29 with a smaller diameter than chamber 23, makes it possible to reduce the liquid flow rate leaving the nozzle.

In addition, the constriction 33 of passage 29 has a diameter of approximately 0.7 to 1.8 mm, which is smaller than the diameter of holes 9b, whose diameter is approximately between 1.4 and 2.5 mm. A smaller constriction 33 and holes 9b would lead to the blocking of the nozzle, whilst a larger constriction 33 and holes 9b would lead to an excessive liquid fertiliser discharge rate.

Member 27a can be placed on the top of nozzle body 21 and its cross-section is then equal to the cross-section of the end 35 of nozzle body 21. The fixing means for member 27a are constituted by a coupling ring 37, which is preferably made from a flexible plastics material locking member 27a and bearing against the end 35 of nozzle member 21 constituting a detachment or step.

The coupling ring is obviously provided with an opening 39, so that it permits the introduction of liquid fertilisers into the nozzle.

According to the embodiment of FIG. 5, the calibrated member 27b can be placed in chamber 23 of nozzle body 21. As chamber 23 has on its walls a detachment or step 41 thereby reducing the diameter of chamber 23, it is possible to false-fit member 27b, whose diameter is greater than that of the chamber 23 defined after step or detachment 41. The detachment or step 41 exists no matter what means are used for fixing member 27 to nozzle body 21, so that the farmer can adapt the spray nozzle 7b to drum 5 (FIG. 2) as a function of the diameter of the threaded outlet 15.

Following the size of the constriction 33 in passage 29 and holes 9b, the nozzle is able to supply liquid fertilisers in the form of droplets having a diameter of 0.5 to 2 mm for a liquid fertiliser intake pressure between 0.5 and 10 bars, because the liquid fertiliser spray flow is dependent not only on the size of constriction 33 and holes 9b, but also on the pressure at which the fertilisers enter the nozzle.

The following table gives an idea of the spray flow rates which can be obtained as a function of the size of the constriction and the pressure of the liquid fertilisers. The case of water of density 1 and a liquid fertiliser containing 40% nitrogen and having a density of 1.28 is illustrated therein.

TABLE OF FLOW RATES PER NOZZLE IN LITERS PER MINUTE

| Size of constriction in mm | Pressure in bars | Flow rate in l/min/nozzle water | Flow rate in l/min/nozzle liquid fertiliser |
|---|---|---|---|
| 1.0 | 1 | 0.58 | 0.66 |
| | 1.5 | 0.65 | 0.74 |
| | 2 | 0.72 | 0.82 |
| | 2.5 | 0.79 | 0.90 |
| | 3 | 0.85 | 0.97 |
| | 4 | 0.94 | 1.07 |
| | 5 | 1.04 | 1.18 |
| | 6 | 1.12 | 1.28 |
| | 8 | 1.27 | 1.45 |
| 1.2 | 1 | 0.81 | 0.94 |
| | 1.5 | 0.95 | 1.09 |
| | 2 | 1.05 | 1.21 |
| | 2.5 | 1.15 | 1.31 |
| | 3 | 1.23 | 1.40 |
| | 4 | 1.43 | 1.53 |
| | 5 | 1.46 | 1.66 |
| | 6 | 1.58 | 1.80 |
| | 8 | 1.80 | 2.04 |

We claim:

1. A spray nozzle for the spraying of liquid, comprising:

a nozzle body provided with a cylindrical chamber of given diameter permitting passage of a liquid into a nozzle and at a nozzle liquid outlet a plurality of equidistantly spaced, identical holes, whose axes are inclined relative to a nozzle axis:

a calibrated alumina member positioned at the intake of the liquid into the nozzle defining a passage for the liquid outflow, having a diameter less than the diameter of the chamber, said member having a concave face at the inlet and a constriction of said passage to limit liquid flow entering the nozzle, the liquid flowing directly from the constriction to said holes through at least a portion of the cylindrical chamber; and fixing means securing said member to the nozzle body.

2. A spray nozzle according to claim 1, wherein there is a step on the wall of the chamber.

3. A spray nozzle according to claim 2, wherein the step on the chamber wall which reduces the chamber diameter is used for the fixing means for the calibrated member, whose diameter is greater than the diameter of the chamber defined after the step.

4. A spray nozzle according to claims 1 or 2, wherein the calibrated member fixing means comprise a coupling ring.

5. A spray nozzle according to claim 1, wherein the nozzle body is made from a rigid plastics material.

6. A spray nozzle according to claim 1, wherein the nozzle body has a conical fluid discharge face in such a way that the axes of the holes are perpendicular to this face.

7. A spray nozzle according to claim 1, wherein the inclination of the axes of the holes relative to the nozzle axis is approximately 25°.

8. A spray nozzle according to claim 1, wherein the constriction of the passage of the calibrated member has a diameter between approximately 0.7 and 1.8 mm.

9. A spray nozzle according to claim 1, wherein the holes have a diameter of approximately 1.4 to 2.5 mm.

10. A spray nozzle according to claims 8 or 9, wherein the diameter of the constriction is smaller than the diameter of the holes.

11. A spray nozzle according to claim 1, wherein the fixing means is a coupling ring is made from a flexible plastics material.

* * * * *